US006130591A

United States Patent [19]

Tsuzuki

[11] Patent Number: 6,130,591

[45] Date of Patent: Oct. 10, 2000

[54] BAND-PASS FILTER COMPRISING SERIES COUPLED SPLIT GAP RESONATORS ARRANGED ALONG A CIRCULAR POSITION LINE

[75] Inventor: Genichi Tsuzuki, Nisshin, Japan

[73] Assignee: Advanced Mobile Telecommunication Technology Inc., Aichi, Japan

[21] Appl. No.: 09/084,438

[22] Filed: May 27, 1998

[30] Foreign Application Priority Data

Aug. 25, 1997 [JP] Japan ..... 9-227779

[51] Int. Cl.[7] ..... H01P 1/203; H01B 12/02

[52] U.S. Cl. ..... 333/204; 333/219; 333/99 S; 505/210; 505/701; 505/866

[58] Field of Search ..... 333/99 S, 204, 333/219; 505/210, 700, 701, 866

[56] References Cited

U.S. PATENT DOCUMENTS 5,055,809 10/1991 Sagawa et al. ..... 333/219
5,888,942 3/1999 Matthaei ..... 333/219 X

FOREIGN PATENT DOCUMENTS 2448544 5/1975 Germany ..... 333/219
1308 1/1989 Japan ..... 333/219
1309 1/1989 Japan ..... 333/219

*Primary Examiner*—Benny Lee
*Attorney, Agent, or Firm*—Venable; Richard L. Aitken

[57] ABSTRACT

Herein disclosed is a band-pass filter for a radio wave having a wavelength range of a high frequency, such as a microwave and a milliwave. The band-pass filter comprises: a dielectric substrate; input and output terminals; and a plurality of conductive strip line resonators being capable of resonating with a predetermined wavelength. Each of the strip line resonators has two ends and bent line extending from one end to the other end with a predetermined length corresponding to the wavelength. The one end and the other end are placed face to face with each other to provide a gap therebetween. In the band-pass filter, the plurality as arranged on the dielectric substrate in series and spaced apart from each other at predetermined intervals along a predetermined position line and coupled with each other through the inductive and capacitive coupling to transfer the signal between the resonators one after another. Each of the adjoining resonators has a predetermined intensity of the coupling between them in accordance with a relationship between the positions of the gaps of the adjoining resonators. As a result, the band-pass filter can be miniaturized as regulating a desired intensity of coupling between resonators.

7 Claims, 14 Drawing Sheets

BAND-PASS FILTER COMPRISING SERIES COUPLED SPLIT GAP RESONATORS ARRANGED ALONG A CIRCULAR POSITION LINE

BACKGROUND OF THE INVENTION

1. Field of the Invention

The present invention relates to a band-pass filter for filtering a radio wave having a wavelength range of a high frequency, such as a microwave and a millimeter wave.

2. Description of the Related Art

There have so far been proposed wide varieties of band-pass filters for filtering a radio wave having a wavelength range of a high frequency, such as a microwave and a millimeter wave. This kind of band-pass filter comprises a plurality of resonators, for instance, a wave guide resonator, a cavity resonator or a strip line resonator, being capable of resonating with a desired frequency.

The band-pass filter is utilized for a wide variety of communication equipment which has needed to be miniaturized in recent years. The band-pass filter, therefore, also needs miniaturizing. The use of the strip line resonators can make the band-pass filter to be substantially miniaturized in comparison with the other resonators, i.e., a wave guide resonator or a cavity resonator. For this reason, the band-pass filter including the strip line resonators is useful for the miniaturized communication equipment.

Referring to FIG. 14 of the drawings, there is shown a conventional band-pass filter 1 comprising a plurality of micro strip line resonators represented by the reference numerals 2, 3, 4, 5 and 6 each having a predetermined wavelength for resonating such as a half wavelength $\lambda/2$ or a quarter wavelength $\lambda/4$. The resonators 2–6 are arranged on a dielectric substrate 9 in longitudinally parallel relationship and apart from each other at predetermined intervals represented by the reference characters "La, Lb, Lc and Ld" in FIG. 14. The dielectric substrate 9 has a length represented by the reference character "L" as shown in FIG. 14. The length L of the dielectric substrate 9 should be more than the sum of all of intervals La, Lb, Lc, and Ld.

The radio wave signal is inputted to the first resonator 2 through an input terminal 7. The first resonator 2 resonates with the predetermined wavelength. The resonating signal is then transferred from the first resonator 2 to the second resonator 3 by way of the inductive and capacitive coupling. The signal is transferred from the second resonator 3 through the fifth resonator 6 one after another while each of the resonators resonates with its resonating wavelength. The resonating signal is thus outputted from the fifth resonator 6 through an output terminal 8. The band-pass filter 1 can thus obtain the filtered signal having the desired wavelength.

However, a drawback encountered in the conventional band-pass filter of the above-described nature is that the band-pass filter 1 needs a large amount of strip line resonators, so as to obtain a signal having superior characteristics, for instance, a sharp skirt form of a band-edge and a narrow passing band. Furthermore, the band-pass filter 1 needs to extend the space at the interval La, Lb, Lc and Ld in order to reduce the intensity of the coupling between the resonators 2–6. As a result, not only the length L of the dielectric substrate 9 but also the size of the band-pass filter 1 increases.

SUMMARY OF THE INVENTION

It is an object of the present invention to provide a band-pass filter for a radio wave having a wavelength range of a high frequency, such as a microwave and a millimeter wave. The band-pass filter can be miniaturized under the condition that the intensity of the coupling between resonators is reduced and the filtered signal has superior characteristics.

In accordance with an aspect of the present invention, there is provided a band-pass filter comprising: a dielectric substrate; input and output terminals; and a plurality of conductive strip line resonators being capable of resonating with a predetermined wavelength. Each of the strip line resonators has two ends and bent line extending from one end to the other end with a predetermined length corresponding to the wavelength. The one end and the other end are placed face to face with each other to provide a gap therebetween. The plurality of resonators have a first resonator coupled with the input terminal being capable of resonating with the predetermined wavelength and a second resonator arranged apart from the first resonator at a predetermined interval and coupled with the first resonator through an inductive and capacitive coupling therebetween, being capable of resonating with a predetermined wavelength, and further coupled with the output terminal to output the resonating signal.

In the band-pass filter, the plurality of resonators further have at least a third resonator intervening between the first and second resonators. The plurality of resonators are on the dielectric substrate in series and space apart from each other at predetermined intervals along a loop shape position line extending from the first resonator to the second resonator. The third resonator is coupled with the first and second resonators through the inductive and capacitive coupling so that the signal is transferred from the first resonator to the second resonator through the intervening resonators. Each of the adjoining resonators has a predetermined intensity of the coupling between them in accordance with a relationship between the positions of the gaps of the adjoining resonators.

Each of the strip line resonators may be shaped into a circular form having an opening portion interposed between the one end and the other end.

Alternatively, each of the strip line resonators may be shaped into a U-shaped form having an opening portion interposed between the one end and the other end.

The loop shaped position line may be substantially a circular line encircled around a center of the substrate with a predetermined radius. The interval between the first and second resonators may be larger than that between of any other adjoining resonators.

Alternatively, the band-pass filter further comprises shielding means interposed between the first and second resonators for shielding the electromagnetic to prevent the coupling between the first and second resonators. The band-pass filter further comprises shielding means placed on a center of the loop shaped position line for shielding against electromagnetic energy to prevent the coupling between the resonators except for the adjoining resonators with each other.

In the band-pass filter according to the present invention, the signal may be microwave or millimeter wave.

BRIEF DESCRIPTION OF THE DRAWINGS

The present invention and many of the advantages thereof will be better understood from the following detailed description when considered in connection with the accompanying drawings, wherein.

DESCRIPTION OF THE PREFERRED EMBODIMENTS

Figure 1:
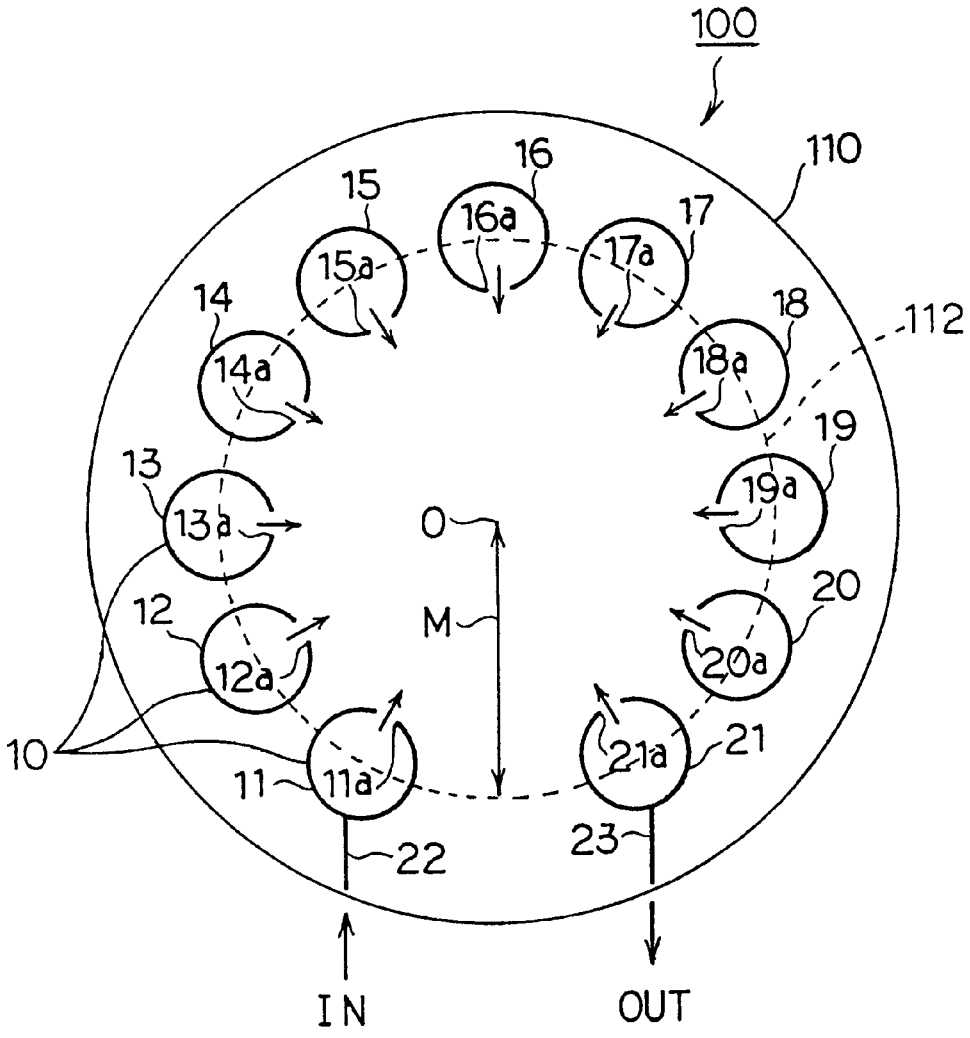
FIG. 1 shows a schematic diagram of a preferred first embodiment of the band-pass filter according to the present invention.

Throughout the following detailed description, similar reference characters and numbers refer to similar elements in all figures of the drawings and they may not be described in detail for all drawing figures.

Referring now to FIGS. 1 through 9 of the drawings, a preferred embodiment of the band-pass filter according to the present invention will be explained hereinafter.

As shown in FIG. 1, the band-pass filter 100 comprises a dielectric substrate 110 and a plurality of conductive strip line resonators 10 serially arranged on the dielectric substrate 110. The dielectric substrate 110 has a ground plate made out of a metal forming a disk shape having a diameter of 50 mm and thickness of 0.3 $\mu$m and a dielectric material layer made out of a dielectric material, such as MgO, $LaAlO_3$ or $Al_2O_3$, deposited on the ground plate to form the dielectric material layer having a thickness of 0.5 mm. In the ground plate of the dielectric substrate 110, the diameter may be 10 mm–100 mm, while the thickness may be 0.1 $\mu$m–10 $\mu$m. In the dielectric material layer of the dielectric substrate 110, the thickness may be 0.1 mm–10 mm.

Each of the strip line resonators 10 is made out of a conductive material, such as a metal, e.g., Au or Cu, or a superconductive material, e.g., $YBa_2Cu_3O_7$, $TlBa_2Ca_2Cu_3O_9$ or Nb, deposited on the dielectric material layer of the dielectric substrate 110 by the conventional pattern formation manner. In this embodiment, each of the strip line resonators 10 is made out of a $YBa_2Cu_3O_7$ having a thickness of 0.3 $\mu$m and a width of 0.5 mm. In each of the strip line resonators 10, the thickness may be 0.1 $\mu$m–10 $\mu$m, while the width may be 0.1 mm–10 mm. The length of each of the resonators 10 will be described in the following description.

Each of the strip line resonators 10 is designed to resonate with a predetermined resonating wavelength of $\lambda/2$. In this embodiment, each of the strip line resonators 10 has two ends and curved line extending from one end to the other end with a predetermined length corresponding to the resonating wavelength to be placed face to face with each other to form a circular form having an opening portion interposed between the one end and the other end. Each of the strip line resonators 10 has a diameter of 10 mm. The length of the opening portion between the one end and the other end may be, but not limited to, 0.5 mm.

The strip line resonators 10 are arranged on the dielectric substrate 110 at predetermined first to eleventh positions represented by the reference numerals "11, 12, 13, 14, 15, 16, 17, 18, 19, 20 and 21" in FIG. 1. In FIG. 1, the resonator placed at the first position 11, hereinafter referred to as "the first resonator 11", is coupled with an input terminal (IN) 22, while the resonator placed at the eleventh position 21, hereinafter referred to as "the eleventh resonator 21", is coupled with an output terminal (OUT) 23. The other resonators placed at the second to tenth positions 12, 13, 14, 15, 16, 17, 18, 19 and 20 are hereinlater referred to as "the second to tenth resonators 12 to 20", respectively.

All of the strip line resonators 11 to 21 are arranged on the dielectric substrate 110 in series and apart from with each other at predetermined intervals of 1–10 mm along a predetermined position line 112 on which the center of each of the circular resonators 11 to 21 is put. The position line 112 represented by the broken line in FIG. 1 extends from the first resonator 11 to the twelfth resonator 21 and is formed into a loop shape having a center "O" and a radius "M". In this embodiment, the radius M may be several mm to 100 mm.

It will be explained hereinafter the operation of the above band-pass filter 100.

The signal is inputted to the band-pass filter 100 through the input terminal (IN) 22. The inputted signal is transferred to the first resonator 11 while the first resonator 11 resonates with its resonating wavelength. The resonating signal is transferred from the first resonator 11 to the second resonator 12 through the inductive and capacitive coupling. The signal is transferred from the second resonator 12 to the adjoining resonator, i.e., the third resonator 13 while the second resonator 12 resonates with its resonating wavelength. Then, the signal is serially transferred between the adjoining resonators through the inductive and capacitive coupling, finally, transferred from the tenth resonator 20 to the eleventh resonator 21 through the inductive and capacitive coupling while each of the resonators resonate with its resonating wavelength. The filtered signal is thus outputted from the band-pass filter 100 through the output terminal (OUT) 23.

It will be understood from the above description of the operation of the band-pass filter 100 that each of resonators is coupled with another resonator through the inductive and capacitive coupling. The intensity of this coupling is determined on the basis of a relationship between the positions of the opening portion of these resonators. As a result, the intensity of the coupling can vary in accordance with variation of the above position relationship.

As shown in FIG. 1, the directions from centers of the resonators 11, 12, 13, 14, 15, 16, 17, 18, 19, 20 and 21 toward the opening portions of the resonators 11, 12, 13, 14, 15, 16, 17, 18, 19, 20 and 21 are represented by the arrows 11*a*, 12*a*, 13*a*, 14*a*, 15*a*, 16*a*, 17*a*, 18*a*, 19*a*, 20*a* and 21*a* respectively. In this embodiment, all of the arrows 11*a* to 21*a* direct toward the center O of the circular position line 112, i.e., the opening portions of the resonators 11 to 21 face the center O of the circular position line 112.

The distance between the center of the first resonator 11 and the center of the eleventh resonator 21 is larger than the distances between the centers of the other resonators, e.g., the first and second resonators 11 and 12 or the second and third resonators 12 and 13, in order to particularly reduce the intensity of the coupling between the input terminal (IN) 22 and the output terminal (OUT) 23 as small as possible. The band-pass filter 100 thus constructed can prevent crosstalk from occurring between the first and eleventh resonators 11 and 21.

Figure 2:
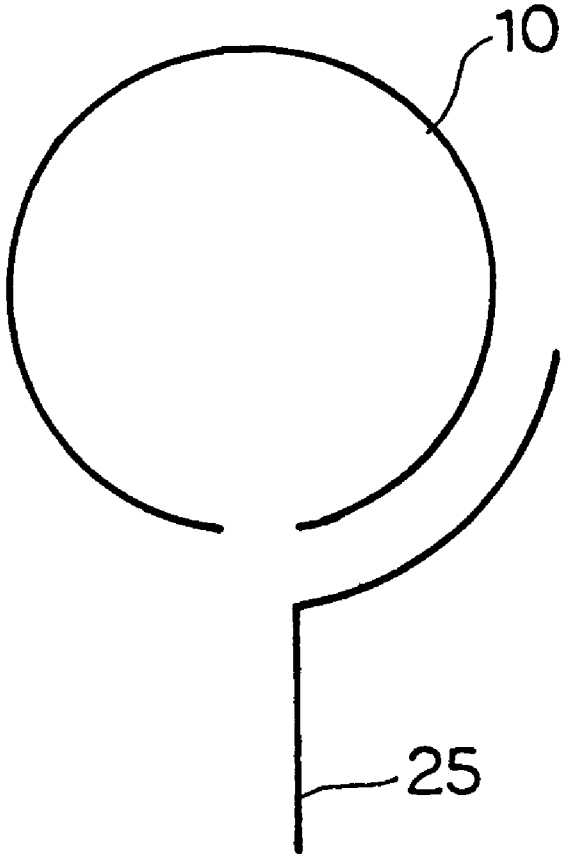
FIG. 2 is an enlarged diagram showing another example of part of input and output terminals of the band-pass filter shown in FIG. 1.

In the first embodiment, the first and eleventh resonators 11 and 21 are coupled with the input terminal (IN) 22 and the output terminal (OUT) 23, respectively, with an electrical tapped connection. Alternatively, the resonator 10 arranged at the first or eleventh positions 11 or 21 in FIG. 1 may be spaced apart from the output terminal 25 as shown in FIG. 2. In this case, the resonator 10 is coupled with the terminal 25 by way of the inductive and capacitive coupling.

Figure 3:
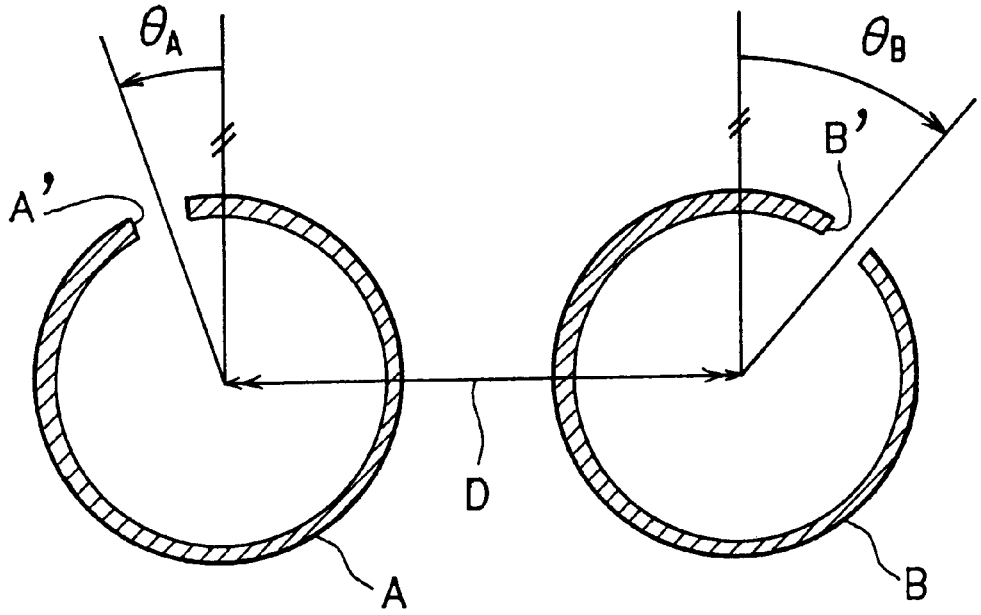
FIG. 3 is an enlarged view of a pair of resonators adjacent to each other shown in FIG. 1 to better illustrate the relationship between the positions of opening portions of the pair of resonators.

FIG. 3 shows a pair of resonators represented by the reference characters "A and B" in explanation for the position relationship between the resonators. The position relationship between the resonators can be determined based on various parameters including a length of the resonator, a distance D between the center of the resonator A and the center the resonator B, and a relationship between the positions of the opening portions A' and B' of the adjoining resonators A and B.

Here, the length of the resonator corresponds to the desired resonating wavelength. The distance D is determined based on the radius M of the position line 112 and the number of the resonators formed on the dielectric substrate 110. As a result, the parameter which can influence the intensity of the coupling between the adjoining resonators is only the position relationship.

The above position relationship is referred to an angle formed by the line between a center of the resonator and an intermediate point between the one end and the other end of the resonator with respect to a vertical axis line vertically extending from the center of the resonator. The angles of the resonators A and B are represented by the reference characters $\theta_A$ and $\theta_B$ in FIG. 3, respectively. In the resonators A and B, the angles $\theta_A$ and $\theta_B$ can independently vary between 0 and 360 degree. Consequently, the intensity of the coupling between the resonators A and B can vary in accordance with the angles $\theta_A$ and $\theta_B$ without varying the distance D.

The first embodiment of the band-pass filter 100 has, therefore, an advantage over the prior art in miniaturizing the band-pass filter and varying the intensity of coupling between the adjoining resonators in accordance with the relationship between the opening portions of the adjoining resonators.

Figure 4:
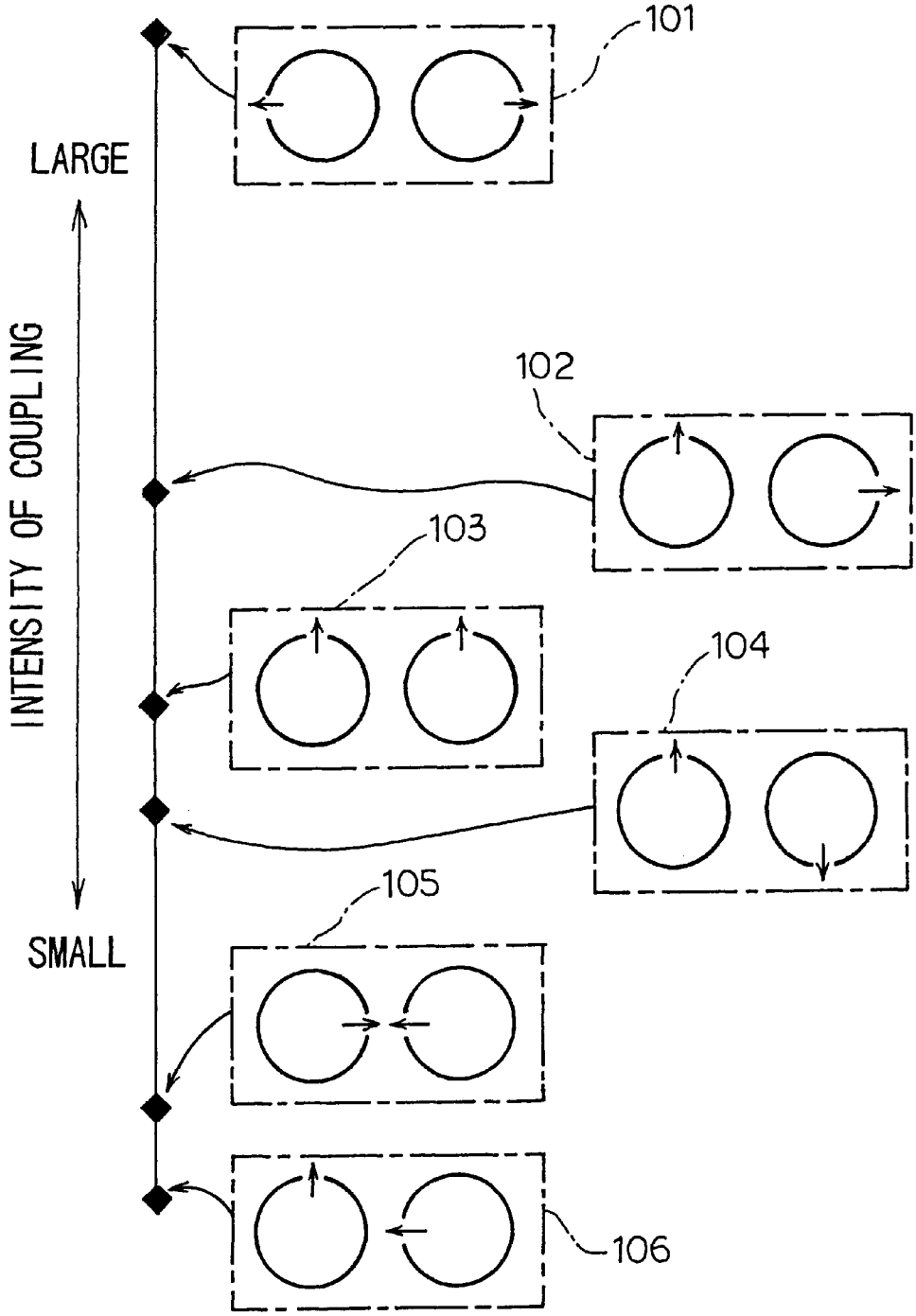
FIG. 4 is a diagram showing a variation of the intensity of coupling of the pair of resonators in accordance with the position relationship between the pair of resonators shown in FIG. 3.

Referring to FIG. 4 of the drawings, there is illustrated a variation of intensity of the coupling in accordance with variety of position relationships between the adjoining resonators. In this case, the length of the resonator is $\lambda/2$. There are shown six examples of the position relationship in FIG. 4. In the first example, in which the opening portion of a pair of resonators 101 are opposite to each other, the intensity of the inductive coupling between them is the largest among all of these examples. Since the length of the resonator is $\lambda/2$, the peak of the wavelength in the resonator, in which the electric current density is the largest, just appears at an adjoining point opposite to the opening portion of the resonator, thereby causing the strong inductive coupling between the resonators.

This means that the intensity of the inductive coupling between the adjoining resonators varies in accordance with the relationship between the positions at which the peaks of the electric current density in the adjoining resonators appear. It will be clearly understood from the above description that the pair of resonators 101 of the first example, a pair of resonators 103 of the third example, a pair of resonators 104 of the fourth example and a pair of resonators 105 of the fifth example are arranged in order of the intensity of the inductive coupling as shown in FIG. 4.

In actual fact the intensity of the coupling between the pair of resonators should be obtained by integrating the intensity of the inductive and capacitive coupling over all of microscopic area in the resonator on the basis of variety of parameters, such as a thickness of the dielectric substrate, a dielectric constant of the dielectric substrate or width and length of the resonator, utilized for designing the band-pass filter. The exact intensity of the coupling should be calculated based on the determined parameters by performing the numerical analysis, for instance, simulation of the electromagnetic filed.

Therefore, in a pair of resonators 102 of the second example and a pair of resonators 106 of the sixth example, the intensity of the coupling between the pair of resonators, in which the arrows indicating the central current density points of them cross at right angle with each other, is indicated as illustrated in FIG. 4, but not limited to these examples.

Figure 5:
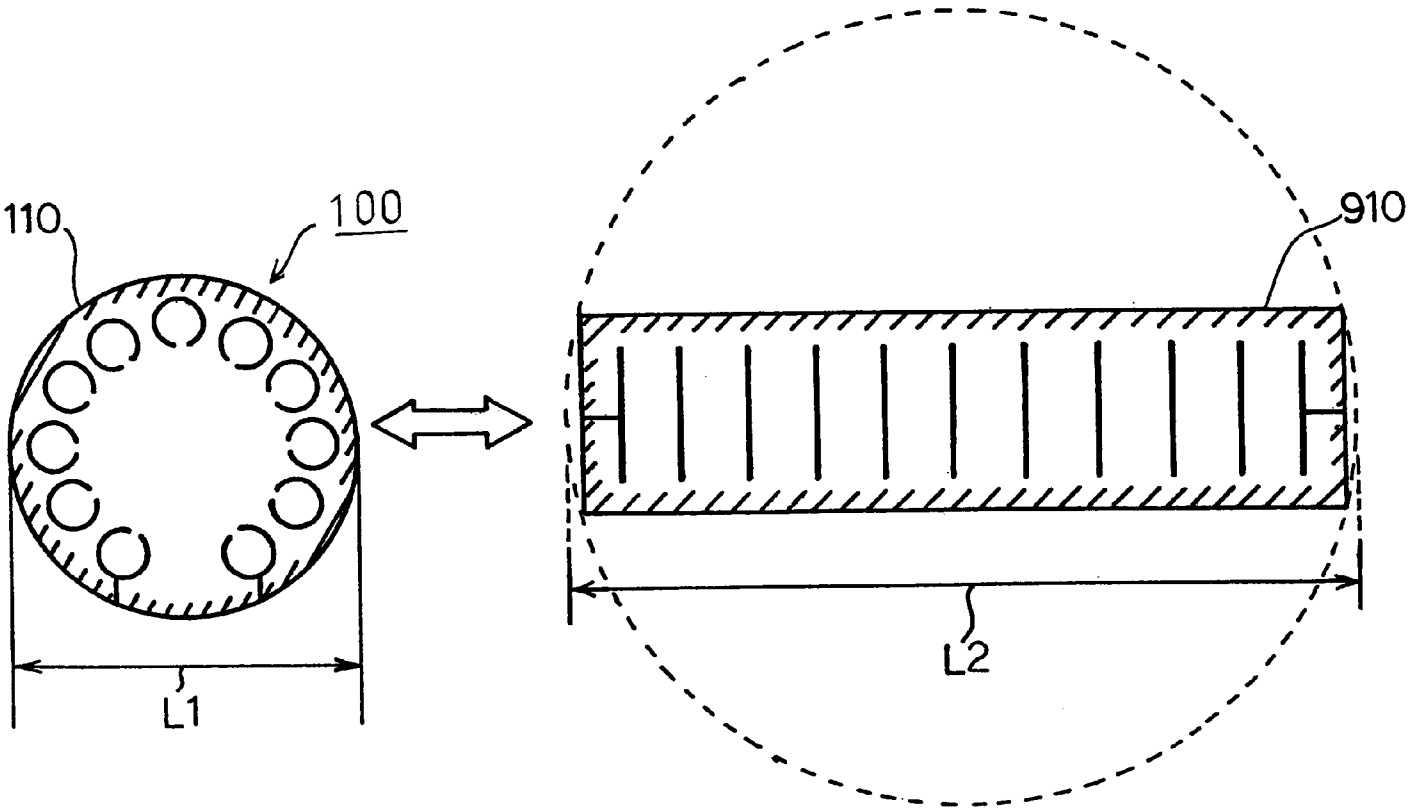
FIG. 5 is a comparative diagram for comparing the size of the band-pass filter shown in FIG. 1 with that of the conventional filter.

Referring to FIG. 5 of the drawings, a comparative diagram in the size of the substrate 110 of the band-pass filter 100 according to the present invention compared with that of the substrate 910 of the conventional filter. In FIG. 5, the diameter of the substrate 110 is represented by the reference character "L1". On the other hand, the reference character "L2" represents a diameter of the disk shaped substrate indicated by a broken line in FIG. 5. This disk shaped substrate is necessary for the substrate 910 of the conventional filter to be made when the present invention of the filter and the conventional filter have the same number of the resonators of 11 and the same characteristics in the coupling. The disk shaped substrate is then cut-off and shaped into a rectangular form.

As shown in FIG. 5, the diameter L1 of the substrate 110 of 2 inches can be reduced in comparison with the diameter L2 in the substrate 910 of the conventional filter of 4 inches. When the substrate has a small dielectric loss, i.e., a single crystal, as well as a large area, it is difficult and expensive to make this substrate. Therefore, the diameter of the substrate may be preferably small in substrate manufacturing process.

Furthermore, the area of the substrate 110 is approximately 2025 $mm^2$, while the area of the substrate 910 of the conventional filter is approximately 4500 $mm^2$. As a result, the area of the substrate 110 can also reduced to less than half of the area of the substrate 910 of the conventional filter.

Therefore, the filter according to the present invention can be miniaturized in comparison with the conventional filter.

Figure 6:
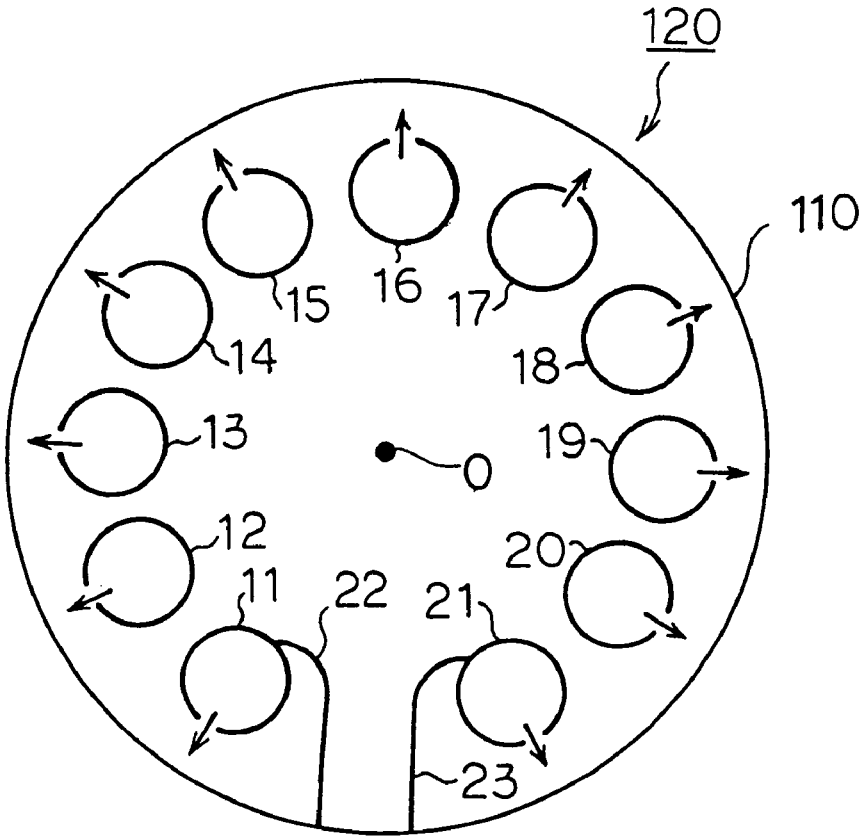
FIG. 6 shows another layout of the resonators arranged on the band-pass filter shown in FIG. 1.

The band-pass filter according to the present invention is not limited to that shown in FIG. 1. FIG. 6 shows another layout diagram of the band-pass filter according to the present invention. As shown in FIG. 6, the band-pass filter 120 has eleven circular strip line resonators same as those of the band-pass filter 100 shown in FIG. 1. The resonators may be arranged in series at the points 11, 12, 13, 14, 15, 16, 17, 18, 19, 20 and 21 on the dielectric substrate 110 so as to have the arrows indicating the directions of the opening portions of the resonators direct toward the outside against the center O.

Figure 7:
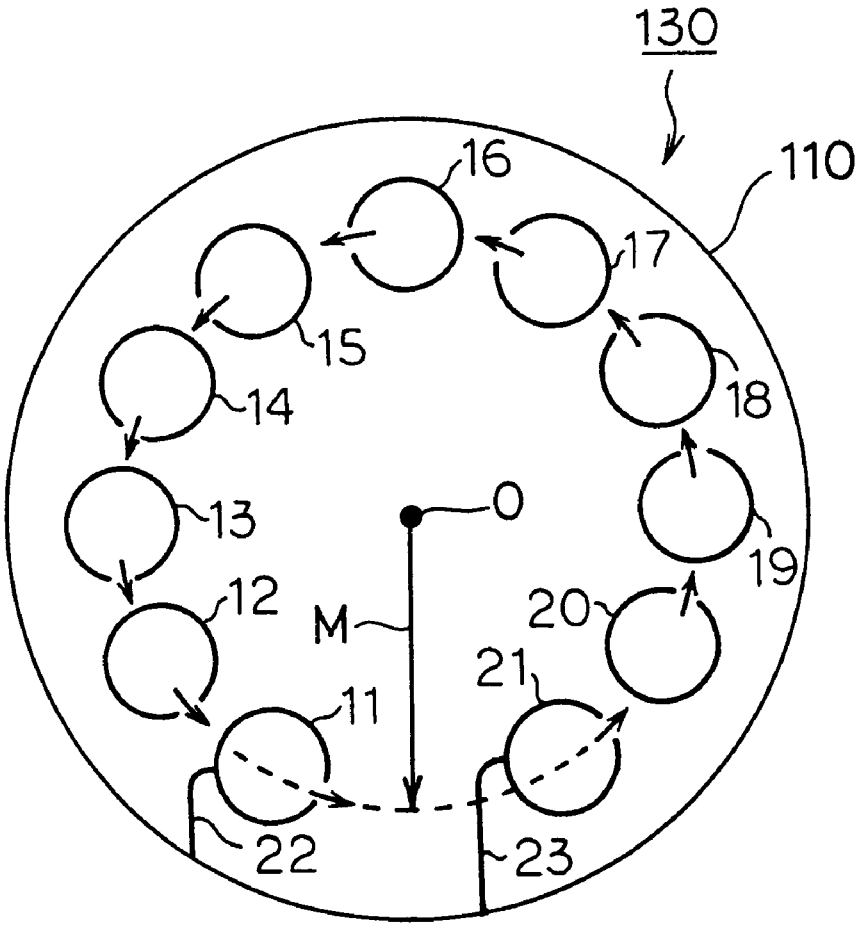
FIG. 7 shows a further alternate layout of the resonators arranged on the band-pass filter shown in FIG. 1.

Furthermore, the layout of the resonators in the band-pass filter may be alternated in the manner as shown in FIG. 7. The resonators of the band-pass filter 130 may be arranged in series at the points 11, 12, 13, 14, 15, 16, 17, 18, 19, 20, and 21 on the dielectric substrate 110 so as to have the arrows direct toward the same directions along the position line 112 as shown in FIG. 7.

Figure 8:
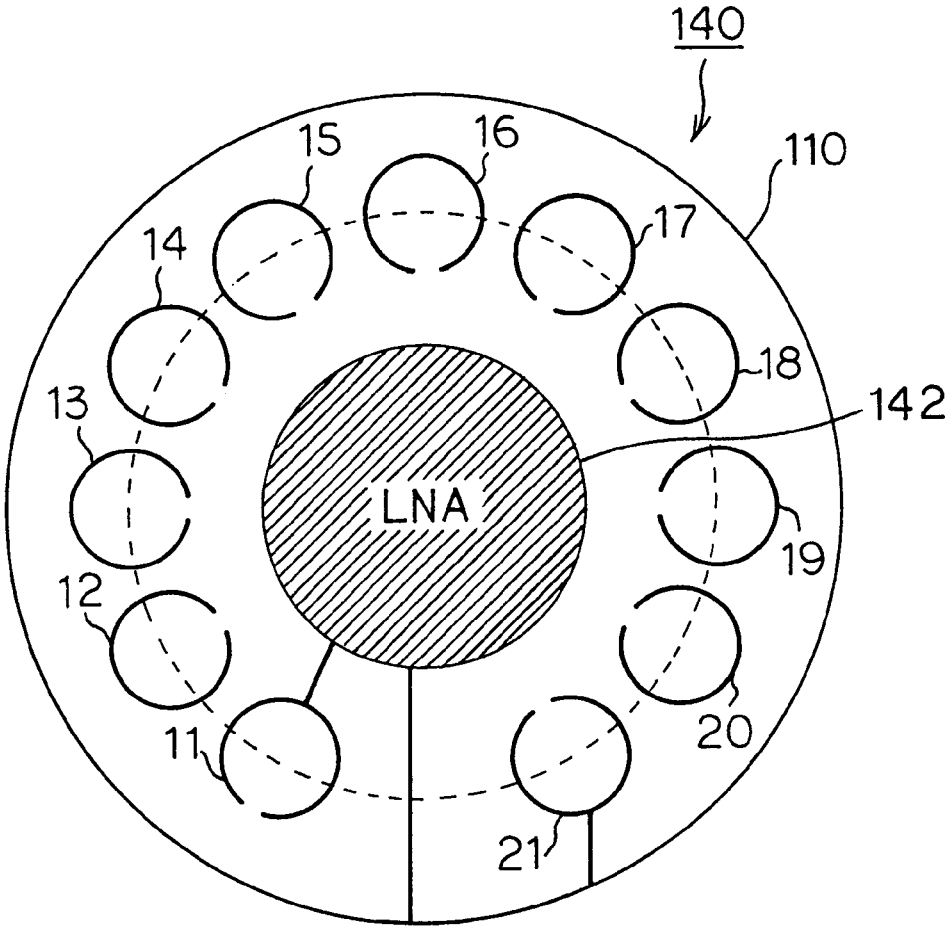
FIG. 8 is a schematic diagram of an alternate example of the band-pass filter shown in FIG. 1 comprising a low noise amplifier.

Alternatively, the band-pass filter 140 may further comprise, if necessary, another suitable peripheral device circuit, such as a low noise amplifier (LNA) located in a center space of the dielectric substrate 110 as shown in FIG. 8. In this case, the band-pass filter 140 thus constructed can reduce the area of the communication equipment including the another peripheral device circuit.

Figure 9:
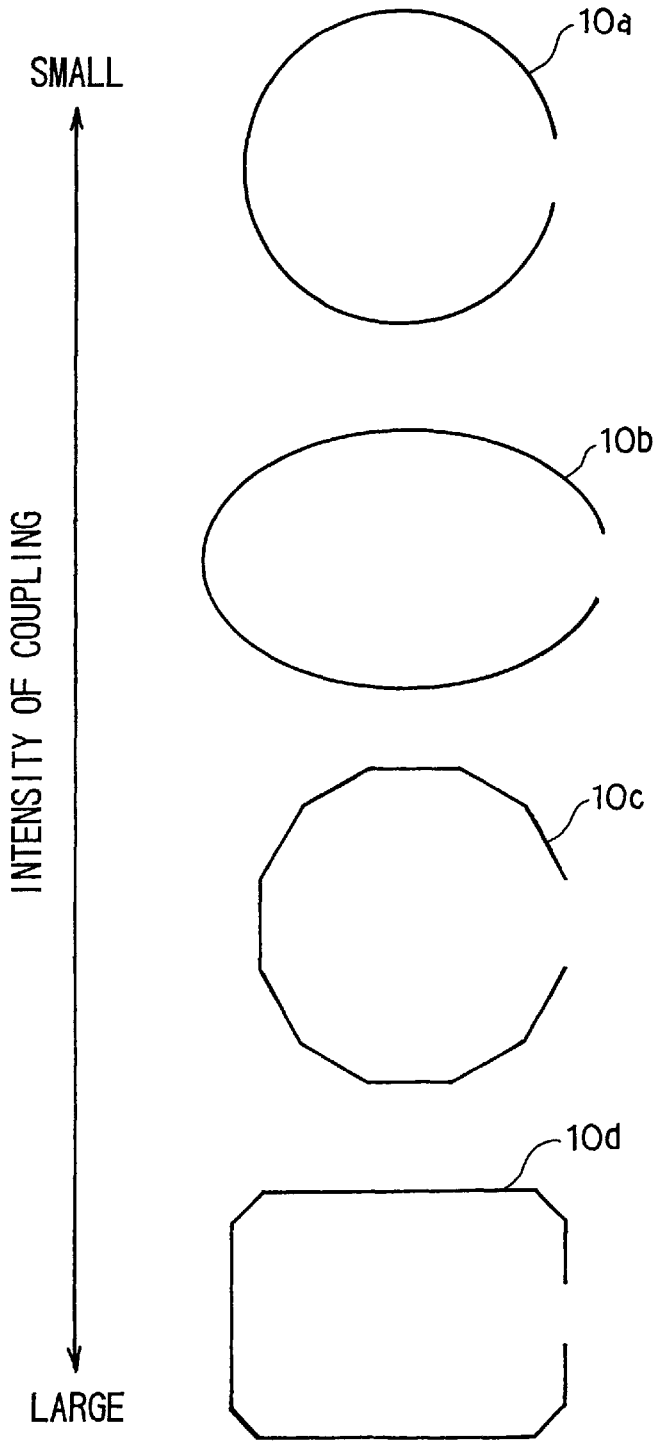
FIG. 9 is a schematic diagram of a variety of form views of the resonators and shows the variation of the intensity of coupling of the pair of resonators in accordance with a pattern of its form.

The resonator 10 of the band-pass filter according to the present invention may have the other forms as shown in FIG. 9. In FIG. 9, the resonator 10*a* has the same form, i.e., a circular form, as the resonator 10 in the above description. The resonator 10*b* has an elliptic shape. The resonator 10*c* has a polygonal shape. The resonator 10*d* has a rectangular shape. As shown in FIG. 9, the variation of the shapes of the resonators result in the variation of the intensity of the coupling, for instance, but not limited to, the circular shape of the resonator 10*a* indicates the smallest intensity, while the rectangular shape of the resonator 10*d* indicates the largest intensity. It will be understood from the above description that the resonator may be formed into any desired shapes so as to obtain the desired intensity of the coupling. The variation of the intensity of the coupling is shown in FIG. 9 as an example under the specific condition in which all of the resonators have the same condition except for the shape of the resonator.

Figure 10:
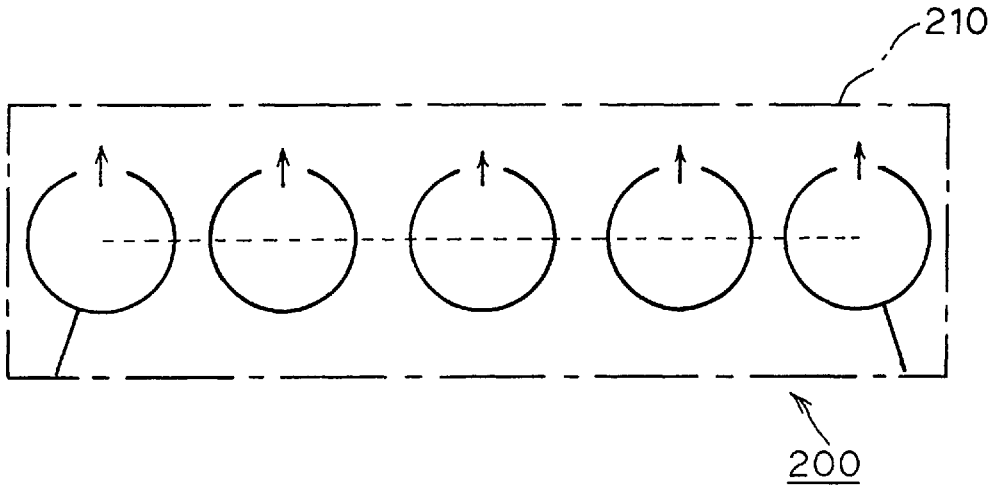
FIG. 10 is a schematic diagram of a preferred second embodiment of the band-pass filter according to the present invention.
Figure 11:
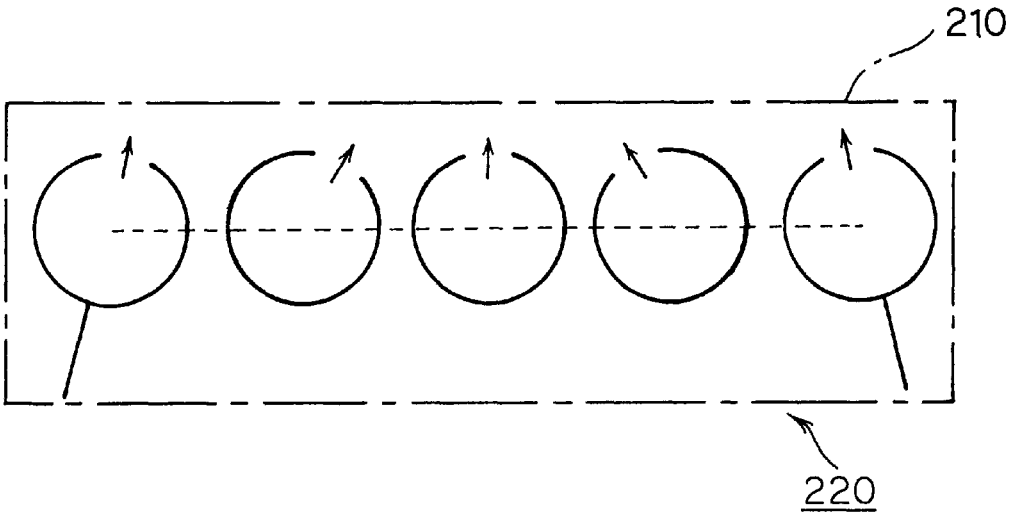
FIG. 11 is a diagram of the band-pass filter shown in FIG. 10 showing still another modification.

Referring to FIGS. 10 and 11, there is shown a second preferred embodiment of the band-pass filter according to the present invention. As shown in FIG. 10, the band-pass filter 200 comprises a dielectric substrate 210 having a rectangular shape and a plurality of strip line resonators. Each of the resonators is the same as that of the first embodiment. The resonators are arranged on the rectangular shaped dielectric substrate 210 in series along a straight line and spaced apart from each other. As shown in FIG. 10, all of the opening portions of the resonators direct toward the same direction vertical with the straight line.

Alternatively, the opening portions of the resonators may direct different directions from each other as shown in FIG. 11. The band-pass filter 220 thus constructed has different characteristic in the coupling from that of the band-pass filter 200 shown in FIG. 10. This results in the fact that the second embodiment of the band-pass filter can also obtain a desired characteristic in the coupling by varying the position relationship between the opening portions of the adjoining resonators without varying the distance between the adjoining resonators.

Figure 12:
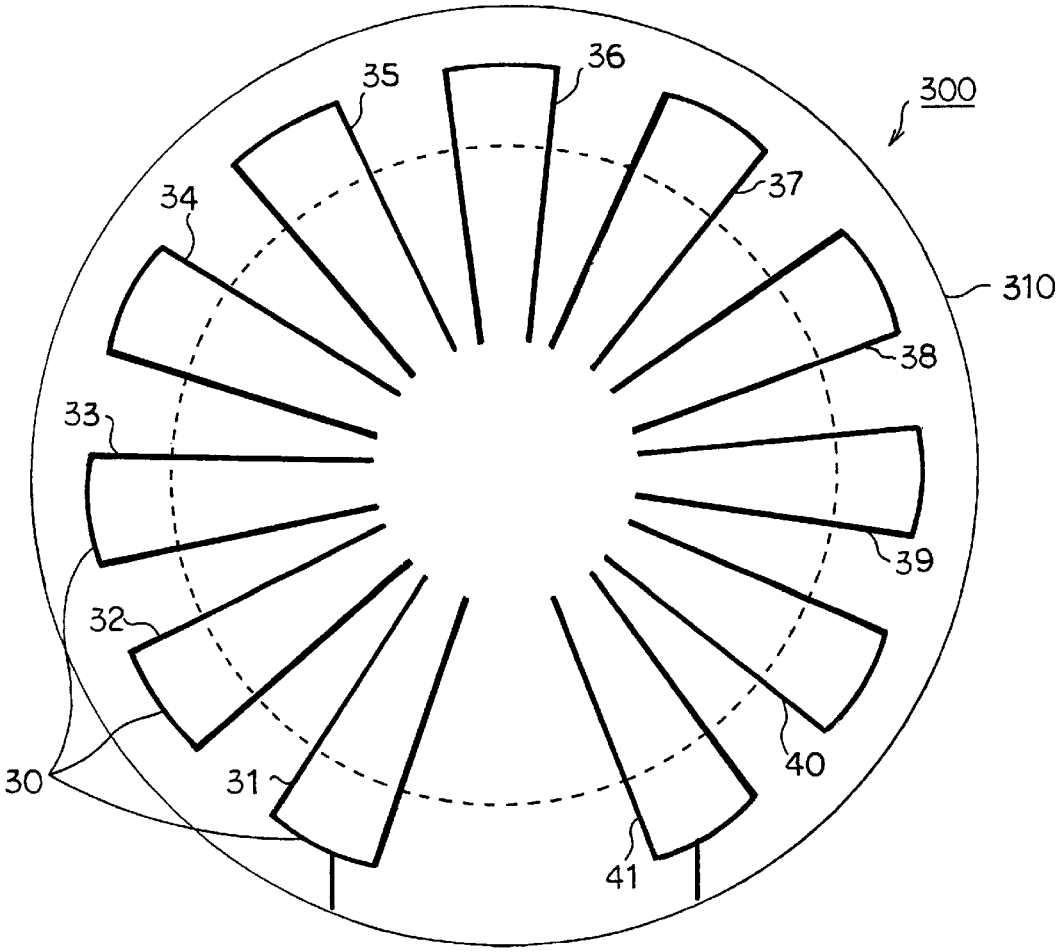
FIG. 12 is a schematic diagram of a preferred third embodiment of the band-pass filter according to the present invention.

Referring to FIG. 12, there is shown a third preferred embodiment of the band-pass filter according to the present invention. As shown in FIG. 12, the band-pass filter 300 comprises a dielectric substrate 310 having a circular shape and a plurality of strip line resonators 30. In this embodiment, each of the strip line resonators 30 has a U-shaped form or a hairpin curved form. Each of the U-shaped resonators 30 has two straight lines radially and outwardly extending from the inside of the dielectric substrate 310 and an arc portion interposed between outside ends of the straight lines to form an opening portion at inside ends of the straight lines. The opening portion of each of the U-shaped resonators 30 faces the center of the dielectric substrate 310. The resonators 30 are arranged at the positions 31, 32, 33, 34, 35, 36, 37, 38, 39, 40 and 41 in series and spaced apart from each other at predetermined intervals along a circular line indicated by the broken line.

In the band-pass filter 300 thus constructed, the length of the resonator 30 can be increased by extending the length of the straight line without extending the area of the dielectric substrate 310. This is essential for the band-pass filter utilized for the low frequency.

Figure 13:
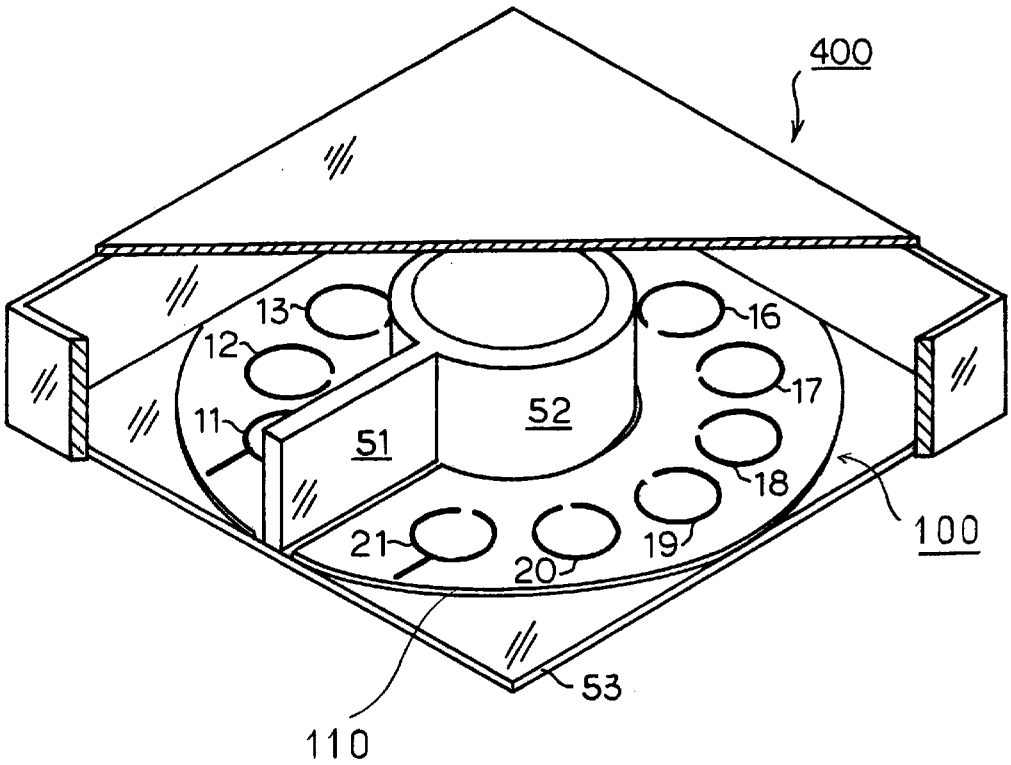
FIG. 13 is partially sectional perspective view of a preferred fourth embodiment of the band-pass filter according to the present invention.
Figure 14:
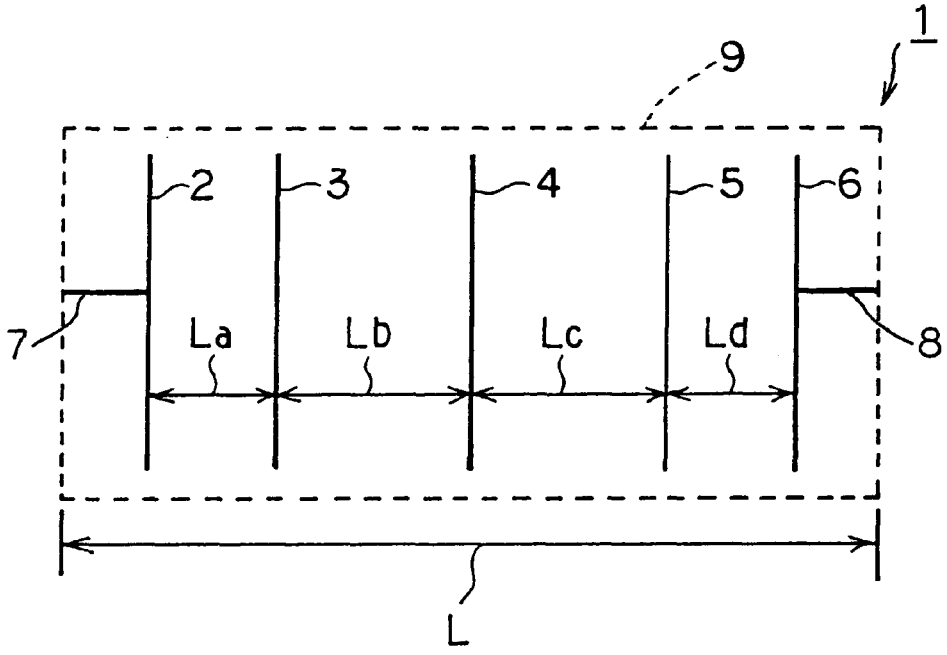
FIG. 14 PRIOR ART
FIG. 14 is a schematic diagram of a conventional filter having a plurality of strip line resonators.

Referring to FIG. 13 of the drawings, a fourth preferred embodiment of the band-pass filter according to the present invention will be described hereinafter. The fourth embodiment of the band-pass filter 400 exemplifies the positive intention of reducing the undesired coupling in the band-pass filter 100 shown in FIG. 1.

As shown in FIG. 13, the band-pass filter 400 comprises a filter case 53 in which the band-pass filter 100 and first and second shields 51 and 52 assemble. The first and second shields 51 and 52 are made of a conductive material, such as a metal, e.g., Au or Cu, or a superconductive material, e.g., $YBa_2Cu_3O_7$, $TlBa_2Ca_2Cu_3O_9$ or Nb, and electrically connected to the filter case 53.

The first shield 51 has, but not limited to, a rectangular board shape having a predetermined width. The first shield 51 stands on the dielectric substrate 110 of the band-pass filter 100 and interposed between the first resonator 11 and the eleventh resonator 21, so that the undesired coupling between the first resonator 11 and the eleventh resonator 21 can be prevented by shielding against electromagnetic energy. The second shield 52 has, but not limited to, a cylindrical shape having a predetermined width. The second shield 52 stands on a center of the dielectric substrate 110 of the band-pass filter 100 to shield against electromagnetic energy to prevent the coupling among the resonators.

The filter case 53 has a bottom plate on which the band-pass filter 100 is located, and side plates each standing along the edge of the bottom plate to encircle the band-pass filter 100 to form a cavity accommodating the band-pass filter 100. The filter case 53 has a top plate to put the lid on the cavity.

The fourth embodiment of the band-pass filter 400 thus constructed has an advantage over the prior art in shielding the undesired coupling between the resonators to lead to the fact that the band-pass filter 400 has an improved quality of the filtering characteristic. Furthermore, the first resonator 11 through the eleventh resonator 21 can be arranged on the dielectric substrate 110 of the band-pass filter 100 as close as possible. This results in the fact that the fourth embodiment has an advantage in miniaturizing the band-pass filter.

The many features and advantages of the invention are apparent from the detailed specification, and thus it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described herein, and accordingly, all suitable modifications and equivalents may be construed as being encompassed within the scope of the invention.

What is claimed is:

1. A band-pass filter comprising:

a dielectric substrate;

input and output terminals; and a plurality of conductive strip line resonators being capable of resonating with a predetermined wavelength, each resonator respectively having two ends and bent line extending from one end thereof to the other end thereof with a predetermined length corresponding to said wavelength, said one end and the other end respectively being placed face to face with each other to provide a corresponding gap therebetween, said plurality of resonators having:

a first resonator coupled with said input terminal, being capable of resonating with said predetermined wavelength;

a second resonator arranged apart from said first resonator at a predetermined interval and coupled with said first resonator through an inductive and capacitive coupling therebetween, being capable of resonating with said predetermined wavelength, and further coupled with said output terminal to output the resonating signal; and at least a third resonator intervening between said first and second resonators, said plurality of resonators being arranged on said dielectric substrate in series and spaced apart from each other at predetermined intervals therebetween along substantially a predetermined circular position line encircled around a center of said substrate with a predetermined radius and extending from said first resonator to said second resonator, said at least a third resonator being coupled with said first and second resonators through the inductive and capacitive coupling to transfer a signal from said first resonator to said second resonator therethrough, adjoining ones of said plurality of resonators having a predetermined intensity of coupling therebetween in accordance with a respective gap position relationship between the positions of said respective gaps of said adjoining ones of said resonators, said plurality of resonators being arranged on said substrate so that substantially all of the signal transferred from said first resonator to said second resonator passes in series from said first resonator through said at least a third resonator to said second resonator.

2. A band-pass filter as set forth in claim 1, in which said respective gaps of said corresponding resonators are directed in the same direction with respect to said circular position line, and said gap position relationship of each of said adjoining ones of said resonators is variable in accordance with a centered angle with respect to the center point of said circular position line, so that said band-pass filter can obtain a desired response.

3. A band-pass filter as set forth in claim 1, in which each of said strip line resonators is a respective circular shape having a corresponding opening portion interposed between said one end and said other end.

4. A band-pass filter as set forth in claim 1, in which each of said strip line resonators is a respective U-shaped shape having a corresponding opening portion interposed between said one end and said other end.

5. A band-pass filter as set forth in claim 1 further comprising shielding means interposed between said first and second resonators for shielding against electromagnetic energy to prevent the coupling between said first and second resonators.

6. A band-pass filter as set forth in claim 1 further comprising shielding means placed on a center of said circular position line for shielding against electromagnetic energy to prevent the coupling between said resonators except for said adjoining resonators with each other.

7. A band-pass filter as set forth in claim 1, in which said interval between said first and second resonators along said circular position line is larger than the interval between any other adjoining resonators positioned on said circular position line.

* * * * *